US008115089B2

(12) United States Patent
Saino et al.

(10) Patent No.: US 8,115,089 B2
(45) Date of Patent: Feb. 14, 2012

(54) APPARATUS AND METHOD FOR CREATING SINGING SYNTHESIZING DATABASE, AND PITCH CURVE GENERATION APPARATUS AND METHOD

(75) Inventors: Keijiro Saino, Hamamatsu (JP); Jordi Bonada, Barcelona (ES)

(73) Assignee: Yamaha Corporation, Hamamatsu-shi (JP)

( * ) Notice: Subject to any disclaimer, the term of this patent is extended or adjusted under 35 U.S.C. 154(b) by 40 days.

(21) Appl. No.: 12/828,375

(22) Filed: Jul. 1, 2010

(65) Prior Publication Data

US 2011/0000360 A1 Jan. 6, 2011

(30) Foreign Application Priority Data

Jul. 2, 2009 (JP) ..... 2009-157527

(51) Int. Cl.
*G10H 1/06* (2006.01)

(52) U.S. Cl. ..... 84/622; 704/258

(58) Field of Classification Search ..... 84/622; 704/258

See application file for complete search history.

(56) References Cited

U.S. PATENT DOCUMENTS

| | | | | |
|---|---|---|---|---|
| 5,327,518 | A * | 7/1994 | George et al. | 704/211 |
| 5,504,833 | A * | 4/1996 | George et al. | 704/211 |
| 6,236,966 | B1 * | 5/2001 | Fleming | 704/259 |
| 7,016,841 | B2 * | 3/2006 | Kenmochi et al. | 704/258 |
| 7,065,489 | B2 * | 6/2006 | Hisaminato et al. | 704/268 |
| 7,842,874 | B2 * | 11/2010 | Jehan | 84/609 |
| 7,977,562 | B2 * | 7/2011 | Qian et al. | 84/622 |
| 2010/0312565 | A1 * | 12/2010 | Wang et al. | 704/260 |

FOREIGN PATENT DOCUMENTS

JP 2002-268660 9/2002

OTHER PUBLICATIONS

Sako, Shinji, et al.; A trainable singing voice synthesis system capable of representing personal characteristics and singing styles, IPSJ SIG Technical Report, Feb. 8, 2008.

Saino, Keijiro, et al.; An HMM-based Singing Voice Synthesis System, Sep. 2006.

European Search Report mailed Oct. 11, 2010, for EP Application No. 10167617.9, five pages.

Gu, H-Y. et al. (Jul. 12, 2008). "Mandarin Singing Voice Synthesis Using ANN Vibrato Parameter Models," *Proceedings of the Seventh International Conference on Machine Learning and Cybernetics*, Piscataway, NJ, Jul. 12-15, pp. 3288-3293.

Saitou, T. et al. (Jul. 1, 2005). "Development of an F0 Control Model Based on F0 Dynamic Characteristics for Singing-Voice Synthesis," *Speech Communication* 46(3-4):405-417.

* cited by examiner

*Primary Examiner* — Jianchun Qin
(74) *Attorney, Agent, or Firm* — Morrison & Foerster LLP

(57) ABSTRACT

Waveform data representative of singing voices of a singing music piece are analyzed to generate melody component data representative of variation over time in fundamental frequency component presumed to represent a melody in the singing voices. Then, through machine learning that uses score data representative of a musical score of the singing music piece and the melody component data, a melody component model, representative of a variation component presumed to represent the melody among the variation over time in fundamental frequency component, is generated for each combination of notes. Parameters defining the melody component models and note identifiers indicative of the combinations of notes whose variation over time in fundamental frequency component are represented by the melody component models are stored into a pitch curve generating database in association with each other.

12 Claims, 5 Drawing Sheets

APPARATUS AND METHOD FOR CREATING SINGING SYNTHESIZING DATABASE, AND PITCH CURVE GENERATION APPARATUS AND METHOD

BACKGROUND

The present invention relates to a singing synthesis technique for synthesizing singing voices (human voices) in accordance with score data representative of a musical score of a singing music piece.

Voice synthesis techniques, such as techniques for synthesizing singing voices and text-reading voices, are getting more and more prevalent these days, and the voice synthesis techniques are broadly classified into one based on a voice segment connection scheme and one using voice models based on a statistical scheme. In the voice synthesis technique based on the voice segment connection scheme, segment data indicative of respective waveforms of a multiplicity of phonemes are prestored in a database, and voice synthesis is performed in the following manner. Namely, segment data corresponding to phonemes, constituting voices to be synthesized, are read out from the database in order in which the phonemes are arranged, and the read-out segment data are interconnected after pitch conversion etc. are performed on the segment data. Many of the voice synthesis techniques in ordinary practical use today are based on the voice segment connection scheme. Among examples of the voice synthesis technique using voice models is one using a Hidden Markov Model (hereinafter referred to as "HMM"). The Hidden Markov Model (HMM) is indented to model a voice on the basis of probabilistic transition between a plurality of states (sound sources). More specifically, each of the states, constituting the HMM, outputs a character amount indicative of its specific acoustic characteristics (e.g., fundamental frequency, spectrum, or characteristic vector comprising these elements), and voice modeling is implemented by determining, by use of the Baum-Welch algorithm or the like, an output probability distribution of character amounts in the individual states and state transition probability in such a manner that variation over time in acoustic character of the voice to be modeled can be reproduced with the highest probability. The voice synthesis using the HMM can be outlined as follows.

The voice synthesis technique using the HMM is based on the premise that variation over time in acoustic character is modeled for each of a plurality of kinds of phonemes through machine learning and then stored into a database. The following describe the above-mentioned modeling using the HMM and subsequent databasing, in relation to a case where a fundamental frequency is used as the character amount indicative of the acoustic character. First, each of a plurality kinds of voices to be learned is segmented on a phoneme-by-phoneme basis, and a pitch curve indicative of variation over time in fundamental frequency of the individual phonemes is generated. Then, for each of the phonemes, an HMM representing the pitch curve with the highest probability is identified through machine learning using the Baum-Welch algorithm or the like. Then, model parameters defining the HMM (HMM parameters) are stored into a database in association with an identifier indicative of one or more phonemes whose variation over time in fundamental frequency is represented by the HMM. This is because, even for different phonemes, characteristics of variation over time fundamental frequency may sometimes be represented by a same HMM. Doing so can achieve a reduced size of the database. Note that the HMM parameters include data indicative of characteristics of a probability distribution defining appearance probabilities of output frequencies of states constituting the HMM (e.g., average value and distribution of the output frequencies, and average value and distribution of change rates (first- or second-order differentiation)) and data indicative of state transition probabilities.

In a voice synthesis process, on the other hand, HMM parameters corresponding to individual phonemes constituting human voices to be synthesized are read out from the database, and a state transition that may appear with the highest probability in accordance with an HMM represented by the read-out HMM parameters and output frequencies of the individual states are identified in accordance with a maximum likelihood estimation algorithm (such as the Viterbi algorithm). A time series of fundamental frequencies (i.e., pitch curve) of the to-be-synthesized voices is represented by a time series of the frequencies identified in the aforementioned manner. Then, control is performed on a sound source (e.g., sine wave generator) so that the sound source outputs a sound signal whose fundamental frequency varies in accordance with the pitch curve, after which a filter process dependent on the phonemes (e.g., a filter process for reproducing spectra or cepstrum of the phonemes) is performed on the sound signal. In this way, the voice synthesis is completed. In many cases, such a voice synthesis technique using HMMs have been used for synthesis of read voices (as disclosed for example in Japanese Patent Application Laid-open Publication No. 2002-268,660). However, in recent years, it has been proposed that the voice synthesis technique for singing synthesis (see, for example, "Trainable Singing Voice Synthesis System Capable of Representing Personal Characteristics and Singing Style", by Sako Shinji, Saino keijiro, Nankaku Yoshihiko and Tokuda Keiichi, in a study report "Musical Information Science" of Information Processing Society of Japan, 2008(12), pp. 39-44 20080208, which will hereinafter be referred to as "Non-patent Literature 1"). In order to synthesize natural singing voices through singing synthesis based on the segment connection scheme, there is a need to database a multiplicity of segment data for each of voice characters (e.g., high clean voice, husky voice, etc.) of singing persons. However, with the voice synthesis technique using HMMs, data indicative of a probability density distribution for generating data of character amounts are retained or stored instead of all of character amounts being stored as data, and thus, such a synthesis technique is suited to be incorporated into small-size electronic equipment, such as portable game machines and portable phones.

In the case where text-reading voices are to be synthesized using HMMs, it is conventional to model a voice using a phoneme as a minimum component unit of a model and taking into account a context, such as an accent type, part of speech and arrangement of preceding and succeeding phonemes; such modeling will hereinafter referred to as "context-dependent modeling". This is because, even for a same phoneme, a manner of variation over time in acoustic character of the phoneme can differ if the context differs. Thus, in performing singing synthesis by use of HMMs too, it is considered preferable to perform context-dependent modeling. However, in singing voices, variation over time in fundamental frequency representative of a melody of a music piece is considered to occur independently of a context of phonemes constituting lyrics, and it is considered that a singing expression unique to a singing person appears in such variation over time in fundamental frequency (namely, melody singing style). In order to synthesize singing voices that accurately reflect therein a singing expression unique to a singing person in question and that sound more natural, it is considered necessary to accurately model the variation over time in fundamental frequency that is independent of the context of phonemes constituting lyrics. However, it is hard to say that the framework of the conventionally-known technique, where the modeling is performed using phonemes as minimum component units of a model, can appropriately model variation over time in fundamental frequency based on a singing expression that straddles across a plurality of phonemes.

SUMMARY OF THE INVENTION

In view of the foregoing, it is an object of the present invention to provide a technique which can accurately model a singing expression unique to a singing person and appearing in a melody singing style of the person and thereby permits synthesis of singing voices that sound more natural.

In order to accomplish the above-mentioned object, the present invention provides an improved singing synthesizing database creation apparatus, which comprises: an input section to which are input learning waveform data representative of sound waveforms of singing voices of a singing music piece and learning score data representative of a musical score of the singing music piece; a melody component extraction section which analyzes the learning waveform data to identify variation over time in fundamental frequency component presumed to represent a melody in the singing voices and then generates melody component data indicative of the variation over time in fundamental frequency component; and a learning section which generates, in association with a combination of notes constituting the melody of the singing music piece, melody component parameters by performing predetermined machine learning using the learning score data and the melody component data, the melody component parameters defining a melody component model that represents a variation component presumed to be representative of the melody among the variation over time in fundamental frequency component between notes in the singing voices, and which stores, into a singing synthesizing database, the generated melody component parameters and an identifier indicative of the combination of notes to be associated with the melody component parameters.

According to the singing synthesizing database creation apparatus of the present invention, melody component data, representative of variation over time in fundamental frequency component presumed to represent a melody, are generated from the learning waveform data representative of sound waveforms of the singing voices of the singing music piece. Then, melody component parameters defining a melody component model, representative of a variation component presumed to represent the melody among the variation over time in fundamental frequency are generated through machine learning from the melody component data and learning score data (namely, data indicative of time series of notes constituting the melody of the singing music piece and lyrics to be sung to the notes). Note that the above-mentioned HMM may be used as the melody component model and the above-mentioned HMM parameters may be used as the melody component parameters. The melody component model, defined by the melody component parameters generated in the aforementioned manner, reflects therein a characteristic of the variation over time in fundamental frequency component between notes (i.e., characteristic of a singing style of the singing person) that are indicated by the note identifier stored in the singing synthesizing database in association with the melody component parameters. Thus, the present invention permits singing synthesis accurately reflecting therein a singing expression unique to the singing person, by databasing the melody component parameters in a form classified according to singing persons (i.e., singing person by singing person) and performing singing synthesis based on HMMs using the stored content of the database.

In a preferred embodiment, the learning score data include note data representative of a melody and lyrics data indicative of lyrics associated with individual notes, and the melody component extraction section generates the melody component data by removing a variation component, dependent on any of phonemes constituting lyrics of the singing music piece, from the variation over time in fundamental frequency component of the singing voices represented by the learning waveform data. Even where the singing voices represented by the learning waveform data input to the input section contain a phoneme (e.g., voiceless consonant) presumed to have a great influence on variation over time in fundamental frequency component, such a preferred embodiment can generate accurate melody component data.

According to another aspect of the present invention, there is provided a pitch curve generation apparatus, which comprises: a singing synthesizing database storing therein, separately for each individual one of a plurality of singing persons, 1) melody component parameters defining a melody component model that represents a variation component presumed to be representative of a melody among variation over time in fundamental frequency component between notes in singing voices of the singing person, and 2) an identifier indicative of one or more combinations of notes of which fundamental frequency component variation over time is represented by the melody component model, the melody component parameters and the identifiers being stored in the singing synthesizing database in a form classified according to the singing persons; an input section to which are input singing synthesizing score data representative of a musical score of a singing music piece and information designating any one of the singing persons for which the melody component parameters are stored in the singing synthesizing database; and a pitch curve generation section which synthesizes a pitch curve of a melody of a singing music piece, represented by the singing synthesizing score data, on the basis of a melody component model defined by the melody component parameters, stored in the singing synthesizing database for the singing person designated by the information input via the input section, and a time series of notes represented by the singing synthesizing score data.

Further, the singing synthesizing apparatus of the present invention may perform driving control on a sound source so that the sound source generates a sound signal in accordance with the pitch curve, and it may perform a filter process, corresponding to phonemes constituting the lyrics of the singing music piece, on the sound signal output from the sound source. Note that the singing synthesizing database provided in the pitch curve generation apparatus and singing synthesizing apparatus may be created by the aforementioned singing synthesizing database creation apparatus.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. In this case, the program may be provided to a user in the storage medium and then installed into a computer of the user, or delivered from a server apparatus to a computer of a client via a communication network and then installed into the computer. Further, the processor used in the present invention may comprise a dedicated processor with dedicated logic built in hardware, not to mention a computer or other general-purpose type processor capable of running a desired software program.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION

A. First Embodiment

A-1. Construction

Figure 1:
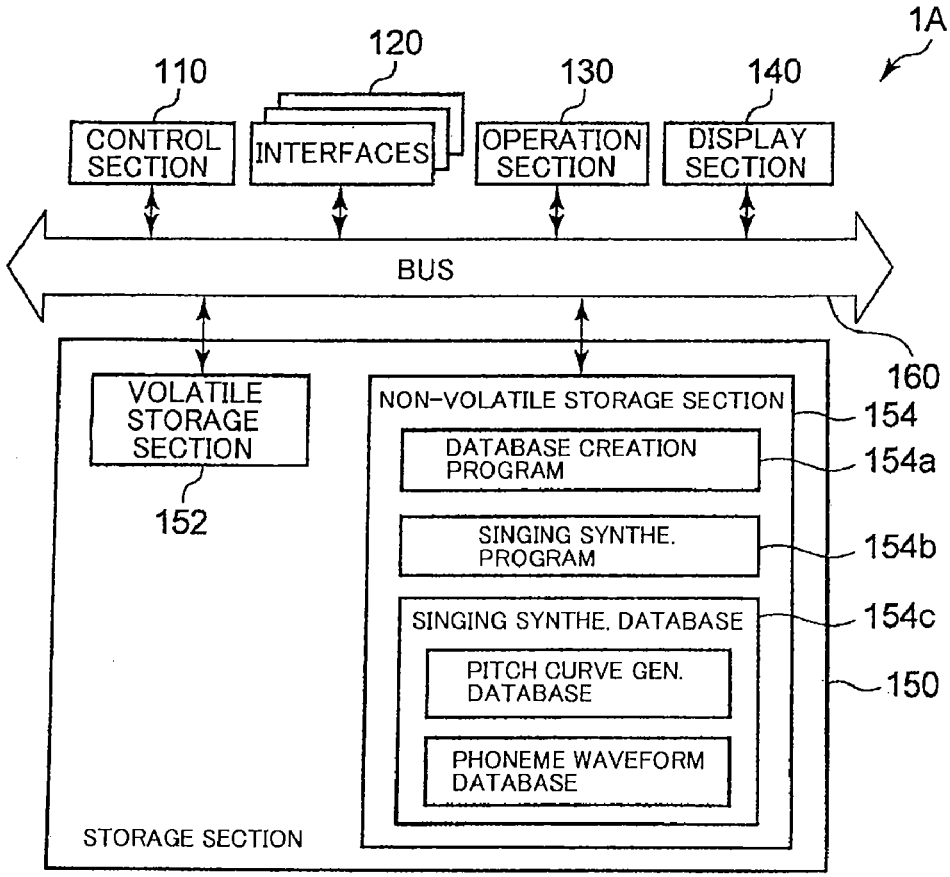
FIG. 1 is a block diagram showing an example general construction of a first embodiment of a singing synthesis apparatus of the present invention.

FIG. 1 is a block diagram showing an example general construction of a first embodiment of a singing synthesis apparatus 1A of the present invention. This singing synthesis apparatus 1A is designed to: generate, through machine learning, a singing synthesizing database on the basis of waveform data indicative of sound waveforms of singing voices obtained by a given person actually singing a given singing music piece (hereinafter referred to as "learning waveform data"), and score data indicative of a musical score of the singing music piece (i.e., a train of note data indicative of a plurality of notes constituting a melody of the singing music piece (in the instant embodiment, rests too are regarded as notes) and a train of lyrics data indicative of a time series of lyrics to be sung to the individual notes; and perform singing synthesis using the stored content of the singing synthesizing database. As shown in FIG. 1, the singing synthesis apparatus 1A includes a control section 110, a group of interfaces 120, an operation section 130, a display section 140, a storage section 150, and a bus 160 for communicating data among the aforementioned components.

The control section 110 is, for example, in the form of a CPU (Central Processing Unit). The control section 110 functions as a control center of the singing synthesis apparatus 1A by executing various programs prestored in the storage section 150. The storage section 150 includes a non-volatile storage section 154 having prestored therein a database creation program 154*a* and a singing synthesis program 154*b*. Processing performed by the control section 110 in accordance with these programs will be described in detail later.

The group of interfaces 120 includes, among others, a network interface for communicating data with another apparatus via a network, and a driver for communicating data with an external storage medium, such as a CD-ROM (Compact Disk Read-Only Memory). In the instant embodiment, learning waveform data indicative of singing voices of a singing music piece and score data (hereinafter referred to as "learning score data") of the singing music piece are input to the singing synthesis apparatus 1A via suitable ones of the interfaces 120. Namely, the group of interfaces 120 functions as input means for inputting learning waveform data and learning score data to the singing synthesis apparatus 1A, as well as input means for inputting score data indicative of a musical score of a singing music piece that is an object of singing voice synthesis (hereinafter referred to as "singing synthesizing score data") to the singing synthesis apparatus 1A.

The operation section 130, which includes a pointing device, such as a mouse, and a keyboard, is provided for a user of the singing synthesis apparatus 1A to perform various input operation. The operation section 130 supplies the control section 110 with data indicative of operation performed by the user, such as drag and drop operation using the mouse and depression of any one of keys on the keyboard. Thus, the content of the operation performed by the user on the operation section 130 is communicated to the control section 110. In the instant embodiment, in response to user's operation on the operation section 130, an instruction for executing any of the various programs and information indicative of a person or singing person of singing voices represented by learning waveform data or a singing person who is an object of singing voice synthesis are input to the singing synthesis apparatus 1A. The display section 140 includes, for example, a liquid crystal display and a drive circuit for the liquid crystal display. On the display section 140 is displayed a user interface screen for prompting the user of the singing synthesis apparatus 1A to operate the apparatus 1A.

As shown in FIG. 1, the storage section 150 includes a volatile storage section 152 and the non-volatile storage section 154. The volatile storage section 152 is, for example in the form of a RAM (Random Access Memory) and functions as a working area when the control section 110 executes any of the various programs. The non-volatile storage section 154 is, for example in the form of a hard disk. In the non-volatile storage section 154 are prestored the database creation program 154*a* and singing synthesis program 154*b*. The non-volatile storage section 154 also stores a singing synthesizing database 154*c*.

Figure 2A:
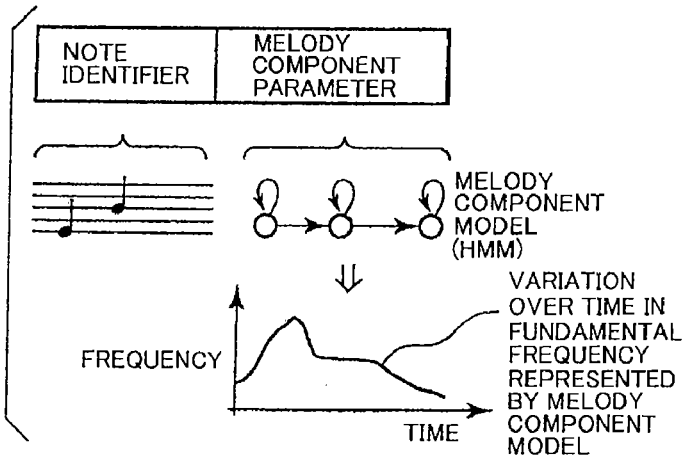
FIGS. 2A and 2*b* are diagrams showing example stored content of a singing synthesizing database.

As shown in FIG. 1, the singing synthesizing database 154*c* includes a pitch curve generating database and a phoneme waveform database. FIG. 2A is a diagram showing an example of stored content of the pitch curve generating database. As shown in FIG. 2A, melody component parameters are stored in the pitch curve generating database in association with note identifiers. As used herein, the melody component parameters are model parameters defining a melody component model which is an HMM that represents, with the highest probability, a variation component that is presumed to indicate a melody among variation over time in fundamental frequency component (namely, pitch) between notes (this variation component will hereinafter be referred to as "melody component") in singing voices (in the instant embodiment, singing voices represented by learning waveform data). The melody component parameters include data indicative of characteristics of an output probability distribution of output frequencies (or sound waveforms of the output frequencies) of individual states constituting the melody component model, and data indicative of state transition probability; among the above-mentioned characteristics of the output probability distribution are an average value and distribution of the output frequencies, and average value and distribution of change rates (first or second differentiation) and distribution of the output frequencies. The note identifier, on the other hand, is an identifier indicative of a combination of notes of which melody components are represented with a melody component model defined by melody component parameters stored in the pitch curve generating database in association with that note identifier. The note identifier may be indicative of a combination (or time series) of two notes, e.g. "C3" and "E3", of which melody components are represented with a melody component model, or may be indicative of a musical interval or pitch difference between notes, such as "rise by major third". The latter note identifier, indicative of a musical interval or pitch difference, indicates a plurality of combinations of notes having the pitch difference. Further, the note identifier is not necessarily limited to one that is indicative of a combination of two notes (or a plurality of combinations of notes each comprising two notes), it may be indicative of a combination (time series) of three or more notes, e.g. "rest, C3, E3, . . . ".

In the instant embodiment, the pitch curve generating database of FIG. 1 is created in the following manner. Namely, once learning waveform data and learning score data are input, via the group of interfaces 120, to the singing synthesis apparatus 1A and information indicative of one or more persons (singing persons) of the singing voices represented by the learning waveform data is input through operation on the operation section 130, a pitch curve generating database is created for each of the singing persons through machine learning using the learning waveform data and learning score data. The reason why a pitch curve generating database is created for each of the singing persons is that singing expressions unique to the individual singing persons are considered to appear in the singing voices, particularly in a style of variation over time in fundamental frequency component indicative of a melody (e.g., a variation style in which the pitch temporarily lowers from C3 and then bounces up to E3 and a variation style in which the pitch smoothly rises from C3 to E3). Further, as compared to the conventionally-known voice synthesis technique using HMMs, where each voice is modeled on the phoneme-by-phoneme basis taking into account the dependency on the context, the instant embodiment of the invention can accurately model a singing expressions unique to each individual singing person because it models a manner or style of variation over time in fundamental frequency component for each combination of notes, constituting a melody of a singing music piece, independently of phonemes constituting lyrics of the music piece.

Figure 2B:
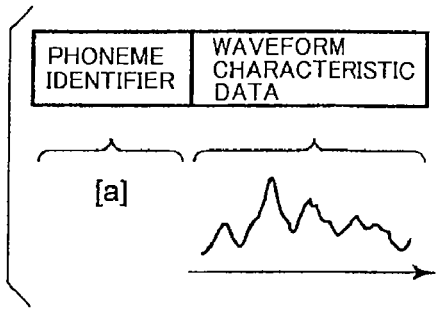

In the phoneme waveform database, as shown in FIG. 2B, there are prestored waveform characteristic data indicative of, among others, outlines of spectral distributions of phonemes in association with phoneme identifiers uniquely identifying respective ones of various phonemes constituting lyrics. As in the conventionally-known voice synthesis techniques, the stored content of the phoneme waveform database is used to perform a filter process dependent on phonemes.

The database creation program 154*a* is a program which causes the control section 110 to perform database creation processing for: extracting note identifiers from a time series of notes represented by learning score data (i.e., a time series of notes constituting a melody of a singing music piece); generating, through machine learning, melody component parameters to be associated with the individual note identifiers, from the learning score data and learning waveform data; and storing, into the pitch curve generating database, the melody component parameters and the note identifiers in association with each other. In the case where the note identifiers are each of the type indicative of a combination of two notes, for example, it is only necessary to extract the note identifiers indicative of combinations of two notes (C3, E3), (E3, C4), . . . sequentially from the beginning of the time series of notes indicated by the learning score data. The singing synthesis program 154*b*, on the other hand, is a program which causes the control section 110 to perform singing synthesis processing for: causing a user to designate, through operation on the operation section 130, any one of singing persons for which a pitch curve generating database has already been created; and performing singing synthesis on the basis of singing synthesizing score data and the stored content of the pitch curve generating database for the singing person, designated by the user, and phoneme waveform database. The foregoing is the construction of the singing synthesis apparatus 1A. Processing performed by the control section 110 in accordance with these programs will be described later.

A-2. Operation

Figure 3:
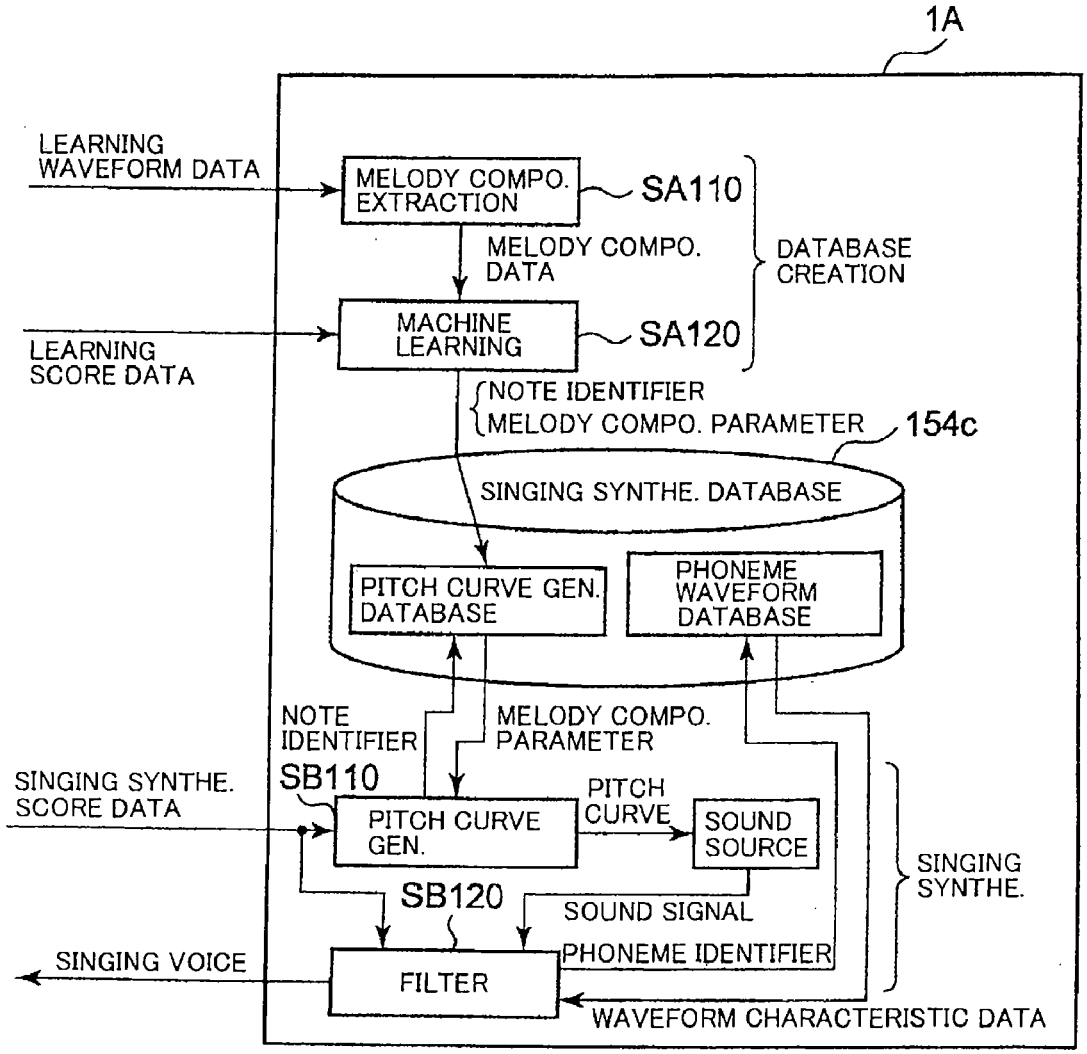
FIG. 3 is a flow chart showing operational sequences of database creation processing and singing synthesis processing performed by a control section of the singing synthesis apparatus.

The following describe various processing performed by the control section 110 in accordance with the database creation program 154*a* and singing synthesis program 154*b*. FIG. 3 is a flow chart showing operational sequences of the database creation processing and singing synthesis processing performed by the control section 110 in accordance with the database creation program 154*a* and singing synthesis program 154*b*, respectively. As shown in FIG. 3, the database creation processing includes a melody component extraction process SA110 and a machine learning process SA120, and the singing synthesis processing includes a pitch curve generation process SB110 and a filter process SB 120.

First, the database creation processing is described. The melody component extraction process SA110 is a process for analyzing the learning waveform data and then generating, on the basis of singing voices represented by the learning waveform data, data indicative of variation over time in fundamental frequency component presumed to represent a melody (such data will hereinafter be referred to as "melody component data"). The melody component extraction process SA110 may be performed in either of the following two specific styles.

In the first style, pitch extraction is performed on the learning waveform data on a frame-by-frame basis in accordance with a pitch extraction algorithm, and a series of data indicative of pitches (hereinafter referred to as "pitch data") extracted from the individual frames are set as melody component data. The pitch extraction algorithm employed here may be a conventionally-known pitch extraction algorithm. In the second style, on the other hand, a component of phoneme-dependent pitch variation (hereinafter referred to as "phoneme-dependent component") is removed from the pitch data, so that the pitch data having the phoneme-dependent component removed therefrom are set as melody component data. An example of a specific scheme for removing the phoneme-dependent component from the pitch data may be as follows. Namely, the above-mentioned pitch data are segmented into intervals or sections corresponding to the individual phonemes constituting lyrics represented by the learning score data. Then, for each of the segmented sections where a plurality of notes correspond to one phoneme, linear interpolation is performed between pitches of the preceding and succeeding notes as indicated by one-dot-dash line in FIG. 4, and a series of pitches indicated by the interpolating linear line are set as melody component data. In such a case, only consonants, rather than all of the phonemes, may be made processing objects. Note that the above-mentioned linear interpolation may be performed using pitches corresponding to the positions of the preceding and following notes or pitches corresponding to opposite end positions of a section corresponding to the consonant. Any suitable interpolation scheme may be employed as long as it can remove a phoneme-dependent pitch variation component.

Namely, with the aforementioned second style employed in the instant embodiment, linear interpolation is performed between pitches represented by the preceding and succeeding notes (i.e., pitches represented by positions of the notes on a musical score (or positions in a tone pitch direction), and a series of pitches indicated by the interpolating linear line are set as melody component data. In short, it is only necessary that the style be capable of generating melody component data by removing a phoneme-dependent pitch variation component, and another style, such as the following, is also possible. For example, the other style may be one in which linear interpolation is performed between a pitch indicated by pitch data at a time-axial position of the preceding note and a pitch indicated by pitch data at a time-axial position of the succeeding note and a series of pitches indicated by the interpolating linear line are set as melody component data. This is because pitches represented by positions, on a musical score, of notes do not necessarily agree with pitches indicated by pitch data (namely, pitches corresponding to the notes in actual singing voices).

Still another style is possible, in which linear interpolation is performed between pitches indicated by pitch data at opposite end positions of a section corresponding to a consonant and then a series of pitches indicated by the interpolating linear line are set as melody component data. Alternatively, linear interpolation may be performed between pitches indicated by pitch data at opposite end positions of a section slightly wider than a section segmented, in accordance with the learning score data, as corresponding to a consonant, to thereby generate melody component data. Because, an experiment conducted by the Applicants has shown that the approach of generating melody component data by performing linear interpolation between pitches at opposite end positions of a section slightly wider than a section segmented in accordance with the learning score data can effectively remove a phoneme-dependent pitch variation component occurring due to the consonant as compared to the approach of generating melody component data by performing linear interpolation between the pitches at the opposite end positions of the section segmented in accordance with the learning score data. Among specific examples of the above-mentioned section slightly wider than the section segmented, in accordance with the learning score data, as corresponding to the consonant are a section that starts at a given position within a section immediately preceding the section corresponding to the consonant and ends at a given position within a section immediately succeeding the section corresponding to the consonant, and a section that starts at a position a predetermined time before a start position of the section corresponding to the consonant and ends at a position a predetermined after an end position of the section corresponding to the consonant.

The aforementioned first style is advantageous in that it can obtain melody component data with ease, but disadvantageous in that it can not extract accurate melody component data if the singing voices represented by the learning waveform data contain a voiceless consonant (i.e., phoneme considered to have particularly high phoneme dependency in pitch variation). The aforementioned second style, on the other hand, is disadvantageous in that it increases a processing load for obtaining melody component data as compared to the first style, but advantageous in that it can extract accurate melody component data even if the singing voices contain a voiceless consonant. The phoneme-dependent component removal may be performed only on consonants (e.g., voiceless consonants) considered to have particularly high dependence on a phoneme in pitch variation. More specifically, in which of the first and second styles the melody component extraction is to be performed may be determined, i.e. switching may be made between the first and second styles, for each set of learning waveform data, depending on whether or not any consonant considered to have particularly high phoneme dependency in pitch variation. Alternatively, switching may be made between the first and second styles for each of the phonemes constituting the lyrics.

Figure 5A:
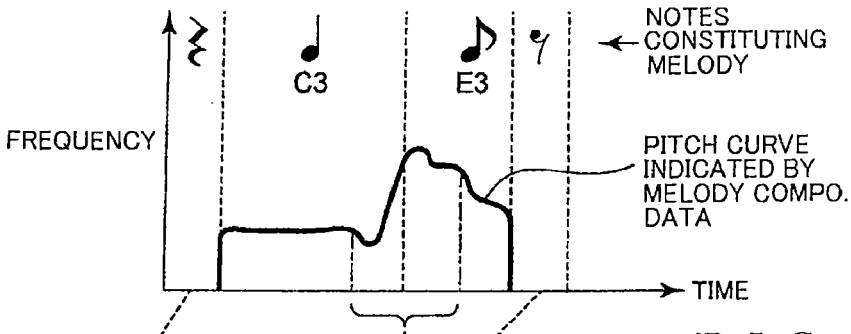
FIGS. 5A to 5C are diagrams showing example HMM modeling of melody components.

In the machine learning process SA120 of FIG. 3, melody component parameters, defining a melody component model (HMM in the instant embodiment) indicative of variation over time in fundamental frequency component (i.e., melody component) presumed to represent a melody in the singing voices represented by the learning waveform data, are generated, per combination of notes, using the learning score data and melody component data, generated by the melody component extraction process SA110, to perform machine learning in accordance with the Baum-Welch algorithm or the like. The thus-generated melody component parameters are stored into the pitch curve generation database in association with a note identifier indicative of the combination of notes of which variation over time in fundamental frequency component is represented by the melody component model. More specifically, in the machine learning process SA120, an operation is first performed for segmenting the pitch curve, indicated by the melody component data, into a plurality of intervals or sections that are to be made objects of modeling. Although the pitch curve may be segmented in various manners, the instant embodiment is characterized by segmenting the pitch curve in such a manner that a plurality of notes are contained in each of the segmented sections. In a case where a time series of notes represented by the learning score data for a section where the fundamental frequency component varies in a manner as shown in FIG. 5A is "quarter rest→quarter note (C3)→eighth note (E3)→eighth rest" as shown in FIG. 5A, the entire section may be set as an object of modeling. It is also conceivable to sub-segment the above-mentioned section into note-to-note transition segment and set these note-to-note transition segment as objects of modeling. Because at least one phoneme corresponds to each note, it is expected that a singing expression straddling across a plurality of phonemes can be appropriately modeled by segmenting the pitch curve in such a manner that a plurality of notes are contained in each of the segmented sections, as mentioned above. Then, in the machine learning process SA120, for each of the segmented objects of modeling, an HMM model which represents variation over time in pitch, indicated by the melody component data, with the highest probability is generated in accordance with the Baum-Welch algorithm or the like.

Figure 5B:
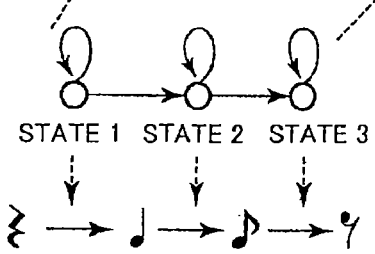
Figure 5C:
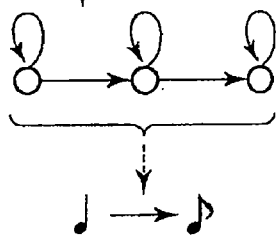

FIG. 5B shows an example result of machine learning performed in a case where the entire section "quarter rest→quarter note (C3)→eighth note (E3)→eighth rest" of FIG. 5A is set as an object of modeling (modeling object). In the example of FIG. 5B, the entire modeling-object section is represented by state transitions between three states: state 1 representing a transition segment from the quarter rest to the quarter note; state 2 representing a transition segment from the quarter note to the eighth note; and state 3 representing a transition segment from the eighth note to the eighth rest. Whereas each of the note-to-note transition segments is represented by one state transition in the illustrated example of FIG. 5B, each transition segment may sometimes be represented by state transitions between a plurality of state transition, or N (N≧2) successive transition segments may sometimes be represented by state transitions between M (M<N) states. By contrast, FIG. 5C shows an example result of machine learning performed with each of the note-to-note transition segments as an object of modeling. In the illustrated example of FIG. 5C, the transition segment from the quarter note to the eighth note is represented by state transitions between a plurality of states (three states in FIG. 5C). Whereas the note-to-note transition segment is represented by state transitions between three states, the transition segment may sometimes be represented by state transitions between two or four or more states depending on the combination of notes in question.

In the case where a transition segment from one note to another is made as an object of modeling as in the example of FIG. 5C, it is only necessary to generate identifiers, each indicative of a combination of two notes like (rest, C3), (C3, E3), . . . , as note identifiers which are to be associated with individual sets of melody component parameters. Further, in the case where an interval or section including three or more notes is made as an object of modeling as in the example of FIG. 5B, it is only necessary to generate identifiers, each indicative of a combination of three or more notes, as note identifiers which are to be associated with individual sets of melody component parameters. In a case where a plurality of combinations of different notes are represented by a same melody component model, it is needless to say that a new note identifier indicative of the combinations of notes, such as "rise by major third" mentioned above, is generated, and that the note identifier and melody component parameters, defining a melody component model representing respective melody components of the combinations of notes, are written into the pitch curve synthesizing database, instead of melody component parameters being writing, for each of the combinations of notes, into the pitch curve synthesizing database. Processing performed in the aforementioned manner is also supported in existing or known machine learning algorithms. The foregoing has been a description about the database creation processing performed in the instant embodiment.

Next, a description will be given about the pitch curve generation process SB110 and filter process SB120 constituting the singing synthesis processing. Similarly to the process performed in the conventionally-known technique using HMMs, the pitch curve generation process SB110 synthesizes a pitch curve corresponding to a time series of notes, represented by the singing synthesizing score data, using the singing synthesizing score data and stored content of the pitch curve generating database. More specifically, the pitch curve generation process SB110 segments the time series of notes, represented by the singing synthesizing score data, into sets of notes each comprising two notes or three or more notes and then reads out, from the pitch curve generating database, melody component parameters corresponding to the sets of notes. For example, in a case where each of the note identifiers used here indicates a combination of two notes, the time series of notes represented by the singing synthesizing score data may be segmented into sets of two notes, and then the melody component parameters corresponding to the sets of notes may be read out from the pitch curve generating database. Then, a process is performed, in accordance with the Viterbi algorithm or the like, for not only identifying a state transition sequence, presumed to appear with the highest probability, by reference to state duration probabilities indicated by the melody component parameters, but also identifying, for each of the states, a frequency presumed to appear with the highest probability on the basis of an output probability distribution of frequencies in the individual states. The above-mentioned pitch curve is represented by a time series of the thus-identified frequencies.

After that, as in the conventionally-known voice synthesis process, the control section 110 in the instant embodiment performs driving control on a sound source (e.g., sine waveform generator (not shown in FIG. 1)) to generate a sound signal whose fundamental frequency component varies over time in accordance with the pitch curve generated by the pitch curve generation process SB110, and then it outputs the sound signal from the sound source after performing the filter process SB120, dependent on phonemes constituting the lyrics indicated by the singing synthesizing score data, on the sound signal. More specifically, in this filter process SB120, the control section 110 reads out the waveform characteristic data stored in the phoneme waveform database in association with the phoneme identifiers indicative of the phonemes constituting the lyrics indicated by the singing synthesizing score data, and then, it outputs the sound signal after performing the filter process SB120 of filter characteristics corresponding to the waveform characteristic data. In the aforementioned manner, singing synthesis of the present invention is realized. The foregoing has been a description about the singing synthesis processing performed in the instant embodiment.

According to the instant embodiment, as described above, melody component parameters, defining a melody component model representing individual melody components between notes constituting a melody of a singing music piece, are generated for each combination of notes; such generated melody component parameters are databased separately, for each singing person. In performing singing synthesis in accordance with the singing synthesizing score data, a pitch curve which represents the melody of the singing music piece represented by the singing synthesizing score data is generated on the basis of the stored content of the pitch curve generating database corresponding to a singing person designated by the user. Because a melody component model defined by melody component parameters stored in the pitch curve generating database represents a melody component unique to the singing person, it is possible to synthesize a melody accurately reflecting therein a singing expression unique to the singing person, by synthesizing a pitch curve in accordance with the melody component model. Namely, with the instant embodiment, it is possible to perform singing synthesis accurately reflecting therein a singing expression based on a style of singing the melody (hereinafter "melody singing expression") unique to the singing person, as compared to the conventional singing synthesis technique for modeling a singing voice on the phoneme-by-phoneme basis or the conventional singing synthesis technique based on the segment connection scheme.

B. Second Embodiment

B-1. Construction

Figure 6:
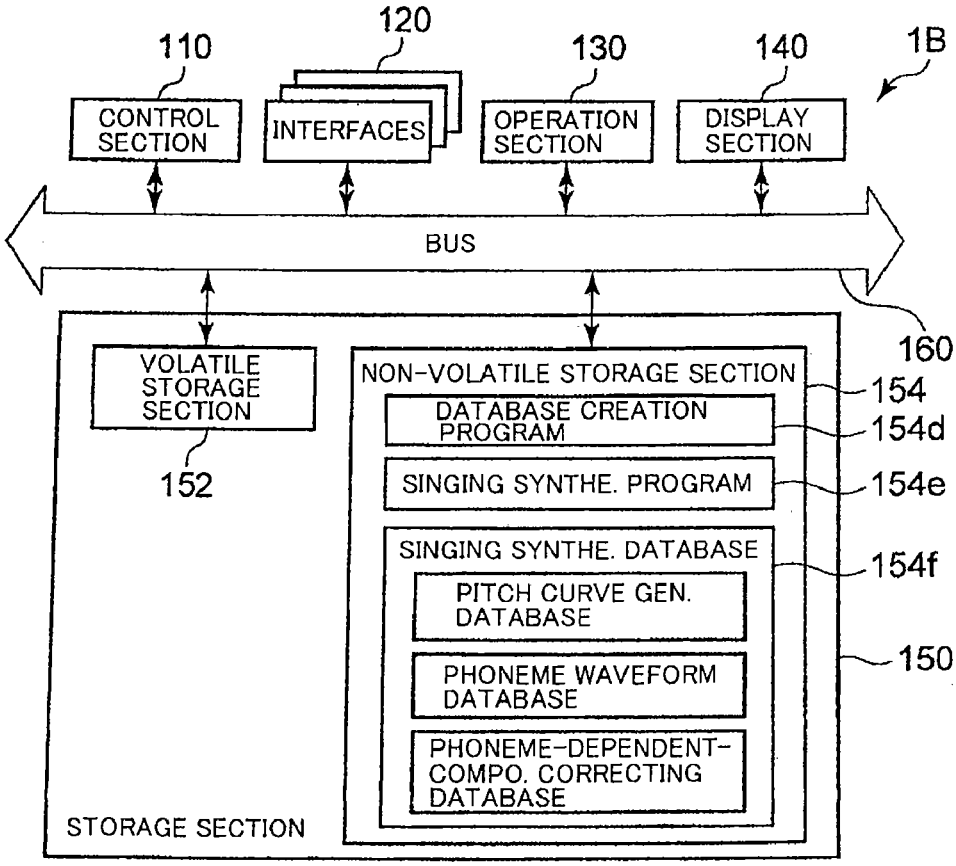
FIG. 6 is a block diagram showing an example general construction of a second embodiment of the singing synthesis apparatus of the present invention.

FIG. 6 is a block diagram showing an example general construction of a second embodiment of the singing synthesis apparatus 1B of the present invention. In FIG. 6, similar elements to those in FIG. 1 are indicated by the same reference numerals as used in FIG. 1. As clear from a comparison between FIGS. 1 and 6, the second embodiment of the singing synthesis apparatus 1B is different from the first embodiment of the singing synthesis apparatus 1A in terms of a software configuration (i.e., programs and data stored in the storage section 150), although it includes the same hardware components (control section 110, group of interfaces 120, operation section 130, display section 140, storage section 150 and bus 160) as the first embodiment of the singing synthesis apparatus 1A. More specifically, the software configuration of the singing synthesis apparatus 1B is different from the software configuration of the singing synthesis apparatus 1A in that a database creation program 154*d*, singing synthesis program 154*e* and singing synthesizing database 154*f* are stored in the non-volatile storage section 154 in place of the database creation program 154*a*, singing synthesis program 154*b* and singing synthesizing database 154*c*. The following describe the second embodiment of the singing synthesis apparatus 1B, focusing primarily on differences from the singing synthesis apparatus 1A.

The singing synthesizing database 154*f* in the singing synthesis apparatus 1B is different from the singing synthesizing database 154*c* in the singing synthesis apparatus 1A in that it includes a phoneme-dependent-component correcting database in addition to the pitch curve generating database and phoneme waveform database. In association with each of phoneme identifiers indicative of phonemes that could influence variation over time in fundamental frequency component in singing voices, HMM parameters (hereinafter referred to as "phoneme-dependent component parameters"), defining a phoneme-dependent component model that is an HMM representing a characteristic of the variation over time in fundamental frequency component occurring due to the phonemes, are stored in the phoneme-dependent-component correcting database. As will be later detailed, such a phoneme-dependent-component correcting database is created for each singing person in the course of database creation processing that creates the pitch curve generating database by use of learning waveform data and learning score data.

B-2. Operation

The following describe various processing performed by the control section 110 of the singing synthesizing apparatus 1B in accordance with the database creation program 154*d* and singing synthesis program 154*e*.

Figure 7:
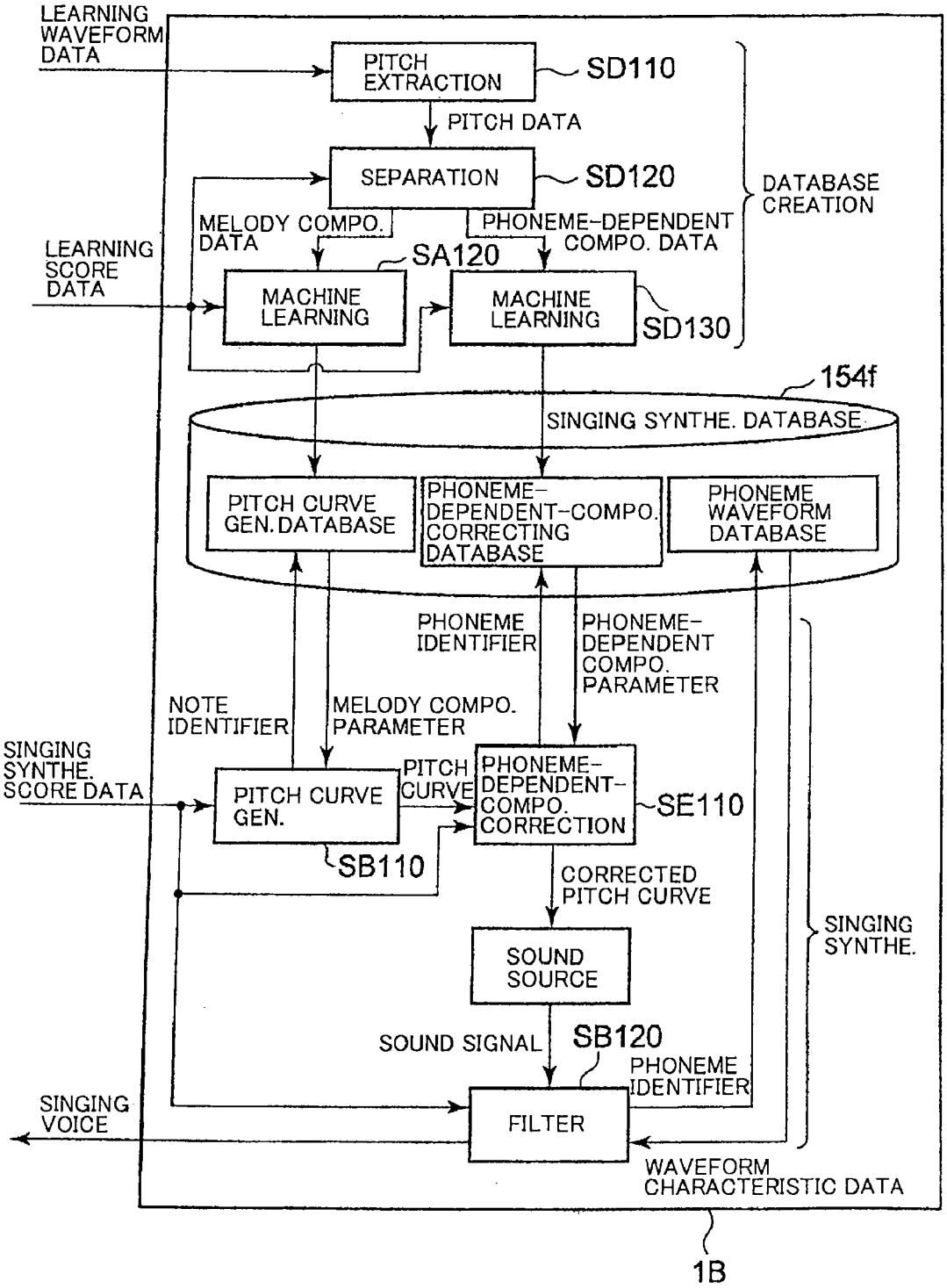
FIG. 7 is a flow chart showing operational sequences of database creation processing and singing synthesis processing performed by a control section of the second embodiment of the singing synthesis apparatus.

FIG. 7 is a flow chart showing operational sequences of database creation processing and singing synthesis processing performed by the control section 110 in accordance with the database creation program 154*d* and singing synthesis program 154*e*, respectively. In FIG. 7, similar operations to those in FIG. 3 are indicated by the same reference numerals as used in FIG. 3. The following describe the database creation processing and singing synthesis processing in the second embodiment, focusing primarily on differences from the database creation processing and singing synthesis processing shown in FIG. 3.

Figure 4:
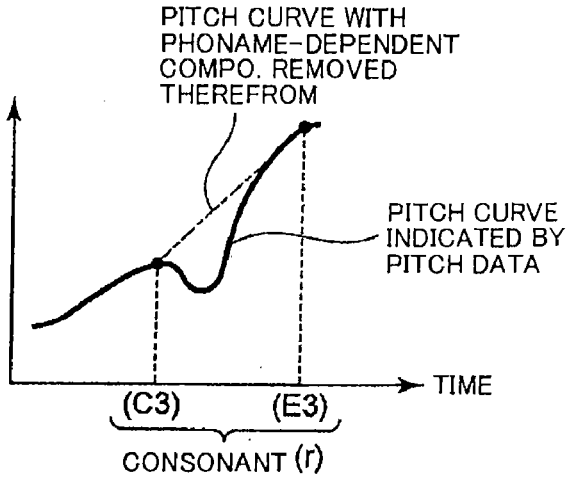
FIG. 4 is a diagram showing example content of a melody component extraction process.

First, the database creation processing is described. As seen in FIG. 7, the database creation processing, performed by the control section 110 in accordance with the database creation program 154*d*, includes a pitch extraction process SD110, separation process SD120, machine learning process SA120 and machine learning process SD130. The pitch extraction process SD110 and separation process SD120, which correspond to the melody component extraction process SA110 of FIG. 3, are processes for generating melody component data in the above-described second style. More specifically, the pitch extraction process SD110 performs pitch extraction on learning waveform data, input via the group of interfaces 120, on a frame-by-frame basis in accordance with a conventionally-known pitch extraction algorithm, and it generates, as pitch data, a series of data indicative of pitches extracted from the individual frames. The separation process SD120, on the other hand, segments the pitch data, generated by the pitch extraction process SD110, into intervals or sections corresponding to individual phonemes constituting lyrics indicated by learning score data, and generates melody component data indicative of melody-dependent pitch variation by removing a phoneme-dependent component from the segmented pitch data in the same manner as shown in FIG. 4. Further, the separation process SD120 generates phoneme-dependent component data indicative of pitch variation occurring due to phonemes; the phoneme-dependent component data are data indicative of a difference between the one-dot-dash line and the solid line in FIG. 4.

0038

As shown in FIG. 7, the melody component data are used for creation of the pitch curve generating database by the machine learning process SA120, and the phoneme-dependent component data are used for creation of the phoneme-dependent-component correcting database by the machine learning process SD130. More specifically, the machine learning process SA120 uses the learning score data and the melody component data, generated by the separation process SD120, to perform machine learning that utilizes the Baum-Welch algorithm or the like. In this manner, the machine learning process SA120 generates per combination of notes, melody component parameters, defining a melody component model (HMM in the instant embodiment) indicative of variation over time in fundamental frequency component (i.e., melody component) presumed to represent a melody in the singing voices represented by the learning waveform data. The machine learning process SA120 further performs a process for storing the thus-generated melody component parameters into the pitch curve generation database in association with the note identifier indicative of the combination of notes of which variation over time in fundamental frequency component is represented by the melody component model defined by the melody component parameters. On the other hand, the machine learning process SD130 uses the learning score data and the phoneme-dependent component data, generated by the separation process SD120, to perform machine learning that utilizes the Baum-Welch algorithm or the like. In this manner, the machine learning process SD130 generates, for each of the phonemes, phoneme-dependent component parameters which define a phoneme-dependent component model (HMM in the instant embodiment) representing a component occurring due to a phoneme that could influence variation over time in fundamental frequency component (namely, the above-mentioned phoneme-dependent component) in singing voices represented by the learning waveform data. The mechanical learning process SD130 further performs a process for storing the phoneme-dependent component parameters, generated in the aforementioned manner, into the phoneme-dependent-component correcting database in association with the phoneme identifier uniquely identifying each of various phonemes of which the phoneme-dependent component is represented by the phoneme-dependent component model defined by the phoneme-dependent-component parameters. The foregoing has been a description about the database creation processing performed in the second embodiment.

Figure 8A:
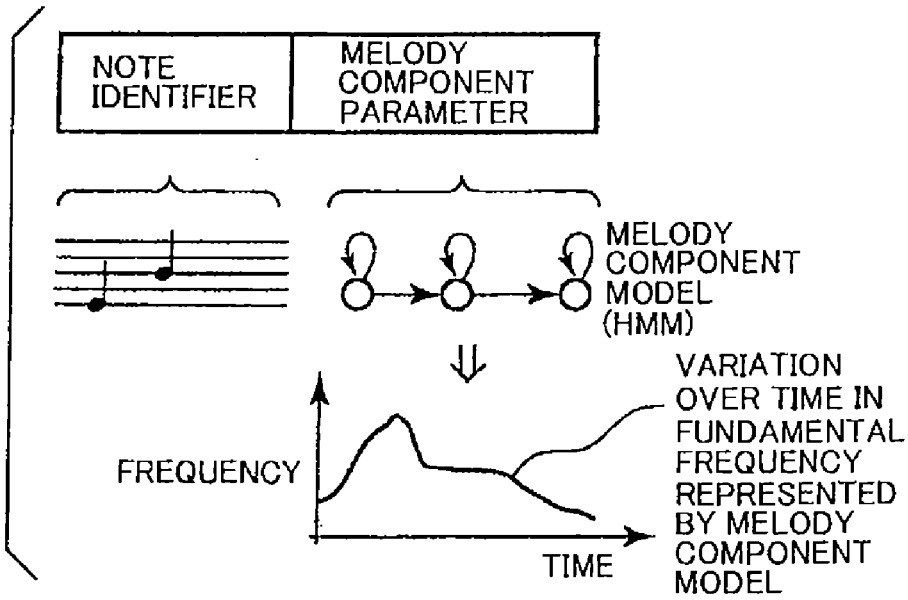
FIGS. 8A and 8*b* are diagrams showing example stored content of a singing synthesizing database of the second embodiment of the singing synthesis apparatus.
Figure 8B:
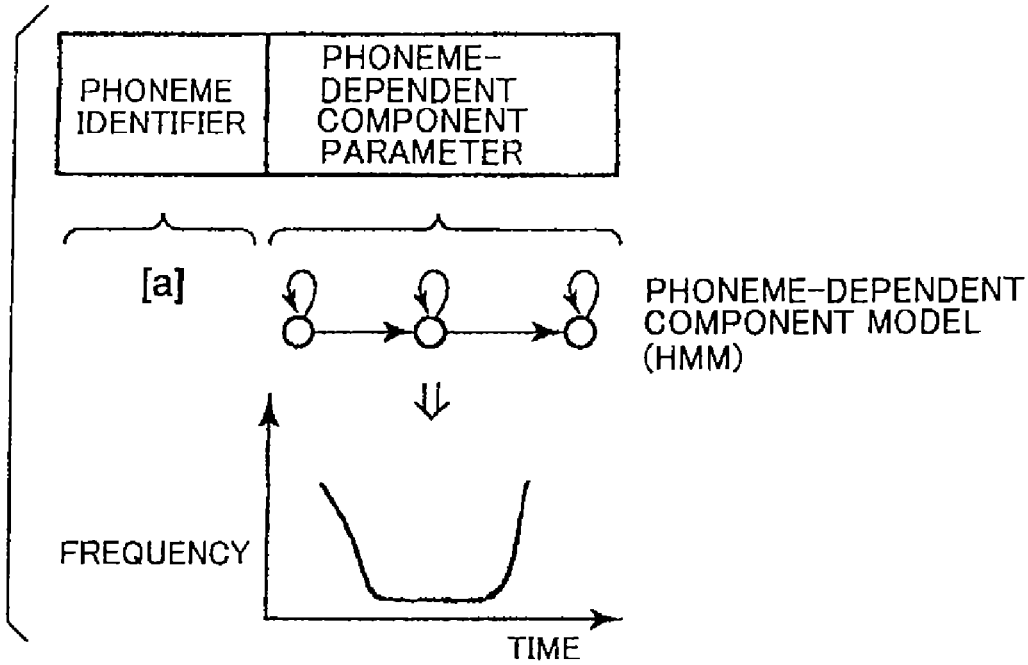

FIG. 8A shows example stored content of the pitch curve generating database storing the melody component parameters generated in the aforementioned manner and the note identifiers corresponding to the pitch curve generating database, which is similar in construction to the stored content shown in FIG. 2A. FIG. 8B shows example stored content of the phoneme-dependent-component correcting database storing the phoneme-dependent component parameters and the phoneme identifiers corresponding thereto. In FIG. 8B, a waveform shown in a lower section of the figure visually shows an example of the phoneme-dependent component data which, as noted above, represents a difference between the one-dot-dash line and the solid line in FIG. 4.

Next, the singing synthesis processing is described. As shown in FIG. 7, the singing synthesis processing, performed by the control section 110 in accordance with the singing synthesis program 154*e*, includes the pitch curve generation process SB110, phoneme-dependent component correction process SE110 and filter process SB120. As shown in FIG. 7, the singing synthesis processing performed in the second embodiment is different from the singing synthesis processing of FIG. 3 performed in the first embodiment in that the phoneme-dependent component correction process SE110 is performed on the pitch curve generated by the pitch curve generation process SB110, a sound signal is output by a sound source in accordance with the corrected pitch curve and then the filter process SB120 is performed on the sound signal. In the phoneme-dependent component correction process SE110, an operation is performed for correcting the pitch curve in the following manner for each of the intervals or sections corresponding to the phonemes constituting the lyrics indicated by the singing synthesizing score data. Namely, the phoneme-dependent component parameters, corresponding to the phonemes constituting the lyrics indicated by the singing synthesizing score data, are read out from the phoneme-dependent component correcting database provided for a singing person designated as an object of the singing voice synthesis, and then the pitch variation represented by the phoneme-dependent component model defined by the phoneme-dependent component parameters is imparted to the pitch curve so that the pitch curve is corrected. Correcting the pitch curve in this manner can generate a pitch curve that reflects therein pitch variation occurring due to a phoneme-uttering style of the singing person as well as a melody singing expression unique to the singing person designated as an object of the singing voice synthesis.

According to the above-described second embodiment, it is possible to perform singing synthesis that reflects therein not only a melody singing expression unique to a designated singing person but also a characteristic of pitch variation occurring due to a phoneme uttering style unique to the designated singing person. Although the second embodiment has been described above in relation to the case where phonemes to be subjected to the pitch curve correction are not particularly limited, the second embodiment may of course be arranged to perform the pitch curve correction only for an interval or section corresponding to a phoneme (i.e., voiceless consonant) presumed to have a particularly great influence on variation over time in fundamental frequency component of singing voices. More specifically, phonemes presumed to have a particularly great influence on variation over time in fundamental frequency component of singing voices may be identified in advance, and the machine learning process SD130 may be performed only on the identified phonemes to create a phoneme-dependent component correcting database. Further, the phoneme-dependent component correction process SE110 may be performed only on the identified phonemes. Furthermore, whereas the second embodiment has been described above as creating a phoneme-dependent component correcting database for each singing person, it may create a common phoneme-dependent component correcting database for a plurality of singing persons. In the case where a common phoneme-dependent component correcting database is created for a plurality of singing persons like this, a characteristic of pitch variation occurring due to a phoneme uttering style that appears in common to the plurality of singing persons is modeled per phoneme by phoneme, and the thus-modeled characteristics are databased. Thus, the second embodiment can perform singing synthesis reflecting therein not only a melody singing expression unique to each of the singing persons but also a characteristic of phoneme-specific pitch variation that appears in common to the plurality of singing persons.

C. Modification

The above-described first and second embodiments may of course be modified variously as exemplified below.

(1) Each of the first and second embodiments has been described above in relation to the case where the individual processes that clearly represent the characteristic features of the present invention is implemented by software. However, a melody component extraction means for performing the melody component extraction process SA110, a machine learning means for performing the machine learning process SA120, a pitch curve generation means for performing the pitch curve generation process SB110 and a filter process means for performing the filter process SB120 may each be implemented by an electronic circuit, and the singing synthesis circuit 1A may be constructed of a combination of these electronic circuits and an input means for inputting learning waveform data and various score data. Similarly, a pitch extraction means for performing the pitch extraction process SD110, a separation means for performing the separation process SD120, machine learning means for performing the machine learning process SA120 and machine learning process SD130 and a phoneme-dependent component correction means for performing the phoneme-dependent component correction process SE110 may each be implemented by an electronic circuit, and the singing synthesis circuit 1B may be constructed of a combination of these electronic circuits and the input means, pitch curve generation means and filter process means.

(2) The singing synthesizing database creation apparatus for performing the database creation processing shown in FIG. 3 (or FIG. 7) and the singing synthesis apparatus for performing the singing synthesis processing shown in FIG. 3 (or FIG. 7) may be constructed as separate apparatus, and the basic principles of the present invention may be applied to individual ones of the singing synthesis apparatus and singing synthesis apparatus. Further, the basic principles of the present invention may be applied to a pitch curve generation apparatus that synthesizes a pitch curve of singing voices to be synthesized. Furthermore, there may be constructed a singing synthesis apparatus which includes the pitch curve generation apparatus and performs singing synthesis by connecting segment data of phonemes, constituting lyrics, while performing pitch conversion on the segment data in accordance with a pitch curve generated by the pitch curve generation apparatus.

(3) In each of the above-described embodiments, the database creation program 154*a* (or 154*d*), which clearly represents the characteristic features of the present invention, is prestored in the non-volatile storage section 154 of the singing synthesis apparatus 1A (or 1B). However, the database creation program 154*a* (or 154*d*) may be distributed in a computer-readable storage medium, such as a CD-ROM, or by downloading via an electric communication line, such as the Internet. Similarly, in each of the above-described embodiments, the singing synthesis program 154*b* (or 154*e*) may be distributed in a computer-readable storage medium, such as a CD-ROM, or by downloading via an electric communication line, such as the Internet.

This application is based on, and claims priority to, JP PA 2009-157527 filed on 2 Jul. 2009. The disclosure of the priority application, in its entirety, including the drawings, claims, and the specification thereof, is incorporated herein by reference.

What is claimed is:

1. A singing synthesizing database creation apparatus comprising:

an input section to which are input learning waveform data representative of sound waveforms of singing voices of a singing music piece and learning score data representative of a musical score of the singing music piece;

a melody component extraction section which analyzes the learning waveform data to identify variation over time in fundamental frequency component presumed to represent a melody in the singing voices and then generates melody component data indicative of the variation over time in fundamental frequency component; and a learning section which generates, in association with a combination of notes constituting the melody of the singing music piece, melody component parameters by performing predetermined machine learning using the learning score data and the melody component data, said melody component parameters defining a melody component model that represents a variation component presumed to be representative of the melody among the variation over time in fundamental frequency component between notes in the singing voices, and which stores, into a singing synthesizing database, the generated melody component parameters and an identifier indicative of the combination of notes to be associated with the melody component parameters.

2. The singing synthesizing database creation apparatus as claimed in claim 1, wherein the learning score data include note data representative of a melody and lyrics data indicative of lyrics associated with individual notes, and said melody component extraction section generates the melody component data by removing a variation component, dependent on any of phonemes constituting lyrics of the singing music piece, from the variation over time in fundamental frequency component of the singing voices represented by the learning waveform data.

3. The singing synthesizing database creation apparatus as claimed in claim 1, wherein said melody component extraction section successively detects pitches of the singing voices, represented by the learning waveform data, in accordance with passage of time, and said melody component extraction section generates the melody component data on the basis of detected time-serial pitch data.

4. The singing synthesizing database creation apparatus as claimed in claim 3, wherein the learning score data include a train of note data representative of a melody and a train of lyrics data indicative of lyrics associated with individual notes, and generating the melody component data on the basis of the time-serial pitch data includes: segmenting the detected time-serial pitch data into data sections, corresponding to individual phonemes constituting lyrics, on the basis of the train of lyrics data contained in the learning score data; and, at each of the sections, removing, from the detected time-serial pitch data, a pitch data variation component between adjacent notes and inserting, in place of the removed pitch data variation component, time-varying pitch data obtained by interpolating between the pitches corresponding to the adjacent notes.

5. The singing synthesizing database creation apparatus as claimed in claim 4, wherein, only for a section corresponding to a consonant, the pitch data variation component between the adjacent notes is removed from the detected time-serial pitch data, and the time-varying pitch data obtained by interpolating between the pitches corresponding to the adjacent notes is inserted in place of the removed pitch data variation component.

6. The singing synthesizing database creation apparatus as claimed in claim 5, wherein, only for a section corresponding to a consonant considered to have particularly high dependence on a phoneme in pitch variation, the pitch data variation component between the adjacent notes is removed from the detected time-serial pitch data, and the time-varying pitch data obtained by interpolating between the pitches corresponding to the adjacent notes is inserted in place of the removed pitch data variation component.

7. The singing synthesizing database creation apparatus as claimed in claim 5, wherein, only for a section corresponding to a voiceless consonant, the pitch data variation component between the adjacent notes is removed from the detected time-serial pitch data, and the time-varying pitch data obtained by interpolating between the pitches corresponding to the adjacent notes is inserted in place of the removed pitch data variation component.

8. The singing synthesizing database creation apparatus as claimed in claim 1, wherein said learning section segments the melody component data into a plurality of data sections in such a manner that one or more notes are contained in each of the segmented data sections, executes a predetermined machine learning algorithm using the melody component data and learning score data corresponding to the data section, and, as a result of the machine learning, generates the melody component parameters, defining a melody component model for each one of the sections, in association with a combination of notes in the section, and wherein the melody component parameters defining the melody component model are associated with one or more said identifiers each indicative of a combination of notes.

9. The singing synthesizing database creation apparatus as claimed in claim 1, wherein said learning section executes a Baum-Welch algorithm, as the predetermined machine learning, to generate the melody component parameters, defining the melody component models, in accordance with a Hidden Markov Model.

10. The singing synthesizing database creation apparatus as claimed in claim 1, wherein said input section inputs, as the learning waveform data, a plurality of sets of learning waveform data representative of sound waveforms of respective singing voices of a plurality of singing persons, and said learning section classifies melody component parameters, generated on the basis of individual ones of the sets of learning waveform data, according to the singing persons and stores the classified melody component parameters into the singing synthesizing database.

11. A singing synthesizing database creation method comprising:

a step of inputting learning waveform data representative of sound waveforms of singing voices of a singing music piece and learning score data representative of a musical score of the singing music piece;

a step of analyzing the learning waveform data to identify variation over time in fundamental frequency component presumed to represent a melody in the singing voices and then generating melody component data representative of the variation over time in fundamental frequency component; and a step of generating, in association with a combination of notes constituting the melody of the singing music piece, melody component parameters by performing predetermined machine learning using the learning score data and the melody component data, said melody component parameters defining a melody component model that represents a variation component presumed to be representative of the melody among the variation over time in fundamental frequency component between notes in the singing voices, and then storing, into a singing synthesizing database, the generated melody component parameters and an identifier indicative of the combination of notes to be associated with the melody component parameters.

12. A non-transitory computer-readable storage medium containing a program for causing a computer to perform a singing synthesizing database creation method, said singing synthesizing database creation method:

a step of inputting learning waveform data representative of sound waveforms of singing voices of a singing music piece and learning score data representative of a musical score of the singing music piece;

a step of analyzing the learning waveform data to identify variation over time in fundamental frequency component presumed to represent a melody in the singing voices and then generating melody component data representative of the variation over time in fundamental frequency component; and a step of generating, in association with a combination of notes constituting the melody of the singing music piece, melody component parameters by performing predetermined machine learning using the learning score data and the melody component data, said melody component parameters defining a melody component model that represents a variation component presumed to be representative of the melody among the variation over time in fundamental frequency component between notes in the singing voices, and then storing, into a singing synthesizing database, the generated melody component parameters and an identifier indicative of the combination of notes to be associated with the melody component parameters.

* * * * *